US005972497A

United States Patent [19]

Hirwe et al.

[11] Patent Number: 5,972,497

[45] Date of Patent: Oct. 26, 1999

[54] ESTER LUBRICANTS AS HYDROPHOBIC FIBER FINISHES

[75] Inventors: Ashalata S. Hirwe, Hockessin, Del.; William Robert Lanigan, Atlanta, Ga.

[73] Assignee: Fiberco, Inc., Wilmington, Del.

[21] Appl. No.: 08/728,490

[22] Filed: Oct. 9, 1996

[51] Int. Cl.[6] ..... D02G 3/00; B05D 3/02; D04H 1/04

[52] U.S. Cl. ..... 428/361; 428/359; 428/375; 428/391; 428/394; 442/59; 427/384; 427/385.5; 427/387

[58] Field of Search ..... 428/359, 361, 428/375, 391, 394, 364; 8/115.6; 427/384, 387, 385.5

[56] References Cited

U.S. PATENT DOCUMENTS

| | | |
|---|---|---|
| 2,345,734 | 4/1944 | Dickey et al. . |
| 2,842,462 | 7/1958 | Haas et al. . |
| 2,913,407 | 11/1959 | Schiermeier et al. . |
| 2,961,406 | 11/1960 | McNeil . |
| 3,357,919 | 12/1967 | Blaki et al. . |
| 3,382,096 | 5/1968 | Boardman . |
| 3,505,097 | 4/1970 | Ratcliffe . |
| 3,594,355 | 7/1971 | Vandenberg et al. . |
| 3,769,215 | 10/1973 | Sturwold . |
| 3,850,682 | 11/1974 | Sturwold et al. . |
| 3,925,589 | 12/1975 | Sturwold et al. . |
| 3,959,187 | 5/1976 | Kardol et al. . |
| 3,959,560 | 5/1976 | Sturwold et al. . |
| 4,020,212 | 4/1977 | Erickson . |
| 4,051,299 | 9/1977 | Steinmiller . |
| 4,069,160 | 1/1978 | Hawkins . |
| 4,115,621 | 9/1978 | Hawkins . |
| 4,179,543 | 12/1979 | Hawkins . |
| 4,291,093 | 9/1981 | Wishman et al. . |
| 4,294,883 | 10/1981 | Hawkins . |
| 4,324,720 | 4/1982 | Swihart . |
| 4,356,219 | 10/1982 | Boon et al. . |
| 4,474,668 | 10/1984 | Petzold et al. . |
| 4,535,013 | 8/1985 | Kuhn . |
| 4,624,793 | 11/1986 | Phifer et al. . |
| 4,938,832 | 7/1990 | Schmalz . |
| 4,946,375 | 8/1990 | Day et al. . |
| 5,033,172 | 7/1991 | Harrington . |
| 5,045,387 | 9/1991 | Schmalz . |
| 5,232,742 | 8/1993 | Chakravarti . |
| 5,281,378 | 1/1994 | Kozulla . |
| 5,318,735 | 6/1994 | Kozulla . |
| 5,403,426 | 4/1995 | Johnson et al. . |
| 5,431,994 | 7/1995 | Kozulla . |
| 5,441,812 | 8/1995 | Modrak . |
| 5,464,546 | 11/1995 | Bialas et al. . |
| 5,540,953 | 7/1996 | Harrington . |
| 5,545,481 | 8/1996 | Harrington . |
| 5,683,809 | 11/1997 | Freeman et al. . |
| 5,705,119 | 1/1998 | Takeuchi et al. . |

FOREIGN PATENT DOCUMENTS

| | | |
|---|---|---|
| 486158 | 5/1992 | European Pat. Off. . |
| 0516412 | 12/1992 | European Pat. Off. . |
| 557024 | 8/1993 | European Pat. Off. . |
| 630996 | 12/1994 | European Pat. Off. . |
| 719879 | 7/1996 | European Pat. Off. . |
| 965659 | 8/1964 | United Kingdom . |
| 1049100 | 11/1966 | United Kingdom . |
| 94/20664 | 9/1994 | WIPO . |
| 95/19465 | 7/1995 | WIPO . |

OTHER PUBLICATIONS

Advertisement, Hercolube Synthetic Ester Base Stock, Hercules Incorporated, Aqualon Division, Wilmington, DE. undated.

Aqualon, Technical Information, Bulletin ORS–601B, Hercolube 202 Polyol Ester Base Stock for Automotive, Aircraft, and Industrial Lubricants, Aqualon Company, Wilmington, DE., undated.

Aqualon, Product Data, No. 4105, Hercolube Synthetic Esters for Lubricants Base Stocks, Hercules Incorporated, Aqualon Division, Wilmington, DE, 1993, pp. 1–3.

Hercules Food & Functional Products, Bulletin ORS–702, Technical Information, Hercoflex 600, 707, 707A, Plasticizers Comparisons with Commercial Plasticizers in PVC Formulations, Hercules Incorporated, Aqualon Division, Wilmington, DE, pp. 1–3., undated.

Patent Abstracts of Japan, vol. 009, No. 227 (P–338), Sep. 13, 1985 (English Abstract of JP 60 085478 A, May 14, 1985).

Research Disclosure, vol. 157, No. 15747, p.XP002034602, May 10, 1977, Havant Hampshire, UK.

*Primary Examiner*—William Krynski
*Assistant Examiner*—J. M. Gray
*Attorney, Agent, or Firm*—Greenblum & Bernstein, P.L.C.

[57] ABSTRACT

Finish compositions and methods for the manufacture of synthetic fibers and/or fabrics comprise hydrophobic esters of pentaerythritol homologs, such as hydrophobic pentaerythritol ester, as lubricants. These esters may be used by themselves or in conjunction with antistatic agents and/or other lubricants and permit the obtaining of high-strength nonwoven materials with increased production plant line speed and productivity. The finish may be used with a variety of fibers and fabrics.

73 Claims, No Drawings

ESTER LUBRICANTS AS HYDROPHOBIC FIBER FINISHES

BACKGROUND OF THE INVENTION

1. Field of the Invention

This invention relates to achieving fiber processing operations without significant loss of desired hydrophobicity in processed fiber or corresponding nonwoven webs and products through the use of lubricants. This invention relates to the processes of production of the fiber as well as to the resulting fibers and to products, including nonwoven material and items containing nonwoven material, produced from the fibers.

2. Background Information

Hydrophobic woven and nonwoven fibers and fabrics are widely used in both industrial and personal applications. In some applications, for example, in leg cuffs, waist bands and back sheets for diapers or other personal hygiene devices, hydrophobicity is desirable in order to manage the flow of liquids. Hydrophobic fabrics may also be made into sterilizable surgical garb, such as gowns or caps, to protect the patient, medical personnel and others. Other uses of woven and nonwoven hydrophobic fibers and fabrics may be readily ascertained by those of ordinary skill in the art.

While the manufacture of fiber, webs and corresponding nonwoven materials are well-known in the art, attempts to broadly apply such knowledge to produce products in the area of personal hygiene, such as catamenial devices, disposable diapers, incontinence pads and the like, have met with serious technical problems due to significant differences in required fiber-spinning and working characteristics as opposed to properties desired in the final products.

Such products generally must have a fluid-absorbent core, usually comprising one or more layers of absorbent material such as wood pulp, rayon, gauze, tissue and the like. In some cases, super-absorbent powders, such as polyacrylate salt, may be used. To protect a wearer's clothing and surrounding areas from stains or wetting by fluids already absorbed in such a core, a fluid-impervious barrier sheet is usually required. The absorbent device is usually positioned against the body of the user with hydrophilic material facing and contacting the body and the fluid-impervious barrier sheet positioned on the outside or opposite side. Hydrophobic waistbands and leg cuffs are used to control the fluid.

A particularly troublesome technical problem arises when a high degree of hydrophobicity is desired in a nonwoven component produced substantially from conventionally bonded webs of hydrophobic fiber, such as polyolefin-containing webs produced from staple fiber or through spin-bonding.

In general, untreated fiber quickly becomes unworkable due to friction and accumulated static charge generated during conventional spinning, crimping, cutting and/or carding operations. For this reason, the art has long recognized and used a variety of topically applied antistatic agents (antistats) and lubricants which impart hydrophilic properties to an extent sufficient to permit conventional fiber processing. In commercial use, however, such treatment frequently results in a final fiber, web or nonwoven product which is substantially more hydrophilic than desired. Further, because of the nature of commercial high-speed operations, and the somewhat unpredictable affinity of known lubricating and antistatic agents to individual fiber batches of the hydrophobic type, it is often very difficult to maintain adequate control over the wetting characteristics of the final nonwoven product.

Various materials are known for assisting the processing of fibers while rendering and/or maintaining the fiber hydrophobic. Schmalz, U.S. Pat. No. 4,938,832, and European Patent Application No. 486,158, incorporated by reference as if set forth in their entireties herein, describe fiber finish compositions containing at least one neutralized phosphoric acid ester having a lower alkyl group, such as a 1–8 carbon alkyl group, which functions as an antistat, in combination with polysiloxane lubricants. These fibers have excellent properties, particularly for manufacture of hydrophobic nonwoven fabrics for hygienic products such as diapers, adult incontinence and sanitary protection products.

Johnson et al., U.S. Pat. No. 5,403,426, incorporated by reference as if set forth in its entirety herein, describes a method of preparing hydrophobic fiber for processing inclusive of crimping, cutting, carding, compiling and bonding. The surface modifier comprises one or more of a class of water soluble compounds substantially free of lipophilic end groups and of low or limited surfactant properties. The finished staple fiber or nonwoven product exhibits good hydrophobic properties.

Harrington, U.S. Pat. No. 5,540,953, incorporated by reference as if set forth in its entirety herein, describes antistatic compositions useful in the preparation of hydrophobic fibers and nonwoven fabrics. One finish described therein comprises 1) at least one neutralized $C_3$–$C_{12}$ alkyl or alkenyl phosphate alkali metal or alkali earth metal salt, and 2) a solubilizer. A second finish described therein comprises at least one neutralized phosphoric ester salt.

Thus, there is a need to produce thermally bondable fibers that can achieve superior cross-directional strength, elongation and toughness properties in combination with fabric uniformity, loftiness and softness. In particular, there is a need to obtain fibers that can produce nonwoven materials, especially carded, calendered fabrics with cross directional properties on the order of at least about 200 to 400 grams/inch, preferably greater than about 400 grams/inch, and as high as about 650 grams/inch or more, at speeds as high as about 500 ft/min, preferably as high as 700 to 800 ft/min, and even more preferably as high as about 980 ft/min (300 m/min). Further, the fabrics can have an elongation of about 50–200%, and toughness of about 200 to 700 g/in, preferably about 480–700 g/in for nonwoven fabrics having a basis weight of from about 10 g/yd$^2$ to 50 g/yd$^2$. Thus, it is preferred to have these strength properties at a basis weight of about 20 g/yd$^2$, more preferably about 12 to 20 g/yd$^2$.

SUMMARY OF THE INVENTION

It is an object of this invention to provide a fiber finish that permits higher productivity and improved crimping, cutting, carding and/or bonding of polymer fibers or filaments.

It is also an object of the present invention to provide a fiber finish that yields webs and commercial products that exhibit increased strength.

It is also an object of the present invention to prepare hydrophobic polymer fiber or filament for conventional fiber processing, inclusive of crimping, cutting, carding and/or bonding steps, without sacrificing hydrophobic characteristics of the commercial product.

It is also an object of the present invention to provide an improved fiber finish that may be used by itself or in combination with other fiber finish compositions.

It is also an object of the present invention to provide a fiber finish that is compatible with neutralized phosphoric acid esters or other polar antistats.

It is also an object of the present invention to provide a fiber finish that reduces or eliminates powder residue on the processing equipment.

In one aspect of the present invention, it is an object to provide an essentially hydrophobic fiber finish composition comprising at least one ester of pentaerythritol homolog comprising at least one hydrophobic ester of pentaerythritol homolog dimer, and at least one anti-static agent and/or at least one additonal lubricating agent. The hydrophobic ester of pentaerythritol dimer homolog may preferably comprise at least one di-pentaerythritol ester. More preferably, the ester of pentaerythritol homolog may comprise a mixture of mono-pentaerythritol ester and di-pentaerythritol ester. More preferably, the mono-pentaerythritol ester and di-pentaerythritol ester comprise substituents independently selected from the group consisting of hydrogen and $C_1$–$C_{21}$ hydrocarbyl groups. Even more preferably, the mono-pentaerythritol ester and di-pentaerythritol ester comprise substituents independently selected from hydrogen and $C_1$–$C_{21}$ alkyl groups, even more preferably, the substituents are independently selected from hydrogen and $C_1$–$C_{14}$ alkyl groups, even more preferably, from $C_5$–$C_{10}$ alkyl groups, even more preferably, from saturated $C_5$–$C_{10}$ alkyl groups, and even more preferably, from normal saturated $C_5$–$C_{10}$ alkyl groups.

The additional antistatic agent may comprise various antistatic agents, such as, neutralized phosphoric acid esters, hydrocarbyl phosphate esters, ethoxylated hydrocarbyl phosphate esters, partially hydrolyzed hydrocarbyl phosphate esters, and/or, antistatic agents which contain, in addition to an antistatic functional group, a reactive hydrogen group, as well as salts of any of these, where the hydrocarbyl groups may be independently selected from $C_1$–$C_{20}$ alkyl groups, $C_3$–$C_{20}$ cycloalkyl, $C_6$–$C_{20}$ aryl groups, and combinations thereof.

In the finish composition of the present invention, the di-pentaerythritol ester is preferably present in the range of about 1–90% by weight of total pentaerythritol ester, more preferably about 5–85% by weight of total pentaerythritol ester, and more preferably about 12% by weight of total pentaerythritol ester.

The additional lubricating agents may comprise various additional lubricating agents, such as, mineral oils, paraffinic waxes, or polysiloxanes having the general formula

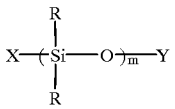

wherein X is a $C_1$–$C_4$ alkyl group; R are independently chosen $C_1$–$C_{10}$ alkyl groups; m is an integer within the range of about 10 or higher; and Y is —$SiR_2$ wherein $R_2$ is a $C_1$–$C_4$ alkyl group.

In another aspect of the present invention, it is an object to provide an essentially hydrophobic polymer fiber which is preferably polyolefin fiber, even more preferably polypropylene fiber, preferably staple fiber, including a coating comprising at least one ester of pentaerythritol homolog comprising at least one hydrophobic ester of pentaerythritol homolog dimer. Preferably, the hydrophobic ester of pentaerythritol dimer homolog comprises at least one di-pentaerythritol ester. Even more preferably, the ester of pentaerythritol homolog comprises a mixture of mono-pentaerythritol ester and di-pentaerythritol ester. Optionally, the coating may comprise at least one antistatic agent and/or at least one lubricating agent. The coating can also contain any combination of components, such as various esters and their combinations, additional lubricating agents and antistatic agents as discussed herein with respect to the composition.

In another aspect of the present invention, it is an object to provide a method of producing substantially hydrophobic polymer fiber comprising applying to polymer fiber an essentially hydrophobic fiber finish composition comprising at least one ester of pentaerythritol homolog comprising at least one hydrophobic ester of pentaerythritol homolog dimer. The polymer fiber is preferably polyolefin fiber, and more preferably polypropylene fiber, and is preferably staple fiber. The coating may comprise about 0.1–1.5% based on the weight of the dry fiber.

In another aspect of the present invention, it is an object to provide methods of producing substantially hydrophobic nonwoven fabric as well as to provide the substantially hydrophobic nonwoven fabrics and products made therefrom. For example, the substantially hydrophobic fiber can be formed into nonwoven fabric. The step of forming the fiber into nonwoven fabric may comprise processing the fiber to obtain at least one web, and bonding the at least one web into nonwoven fabric. Further, the fiber may be crimped prior to processing into the web. Further, the fiber may be cut into staple fiber after crimping and prior to processing into the web.

Again, it is pointed out that in each of the aspects of the invention including the compositions, fibers, processes and nonwovens, the finish composition and coating can contain any combination of components, including any combination of esters, additional lubricating agents and antistatic agents.

DETAILED DESCRIPTION OF THE INVENTION

The present invention is directed to various forms of fibers, including filaments and staple fibers. These terms are used in their ordinary commercial meanings. Typically, herein, "filament" is used to refer to the continuous fiber on the spinning machine; as a matter of convenience, however, the terms fiber and filament are used interchangeably herein. "Staple fiber" is used to refer to cut fibers or filaments. Preferably, the fiber is a staple fiber having a length of about 1 to 6 inches. More preferably, the fiber is cut into a staple fiber having length of about 1 to 3 inches. Preferably, for example, staple fibers for nonwoven fabrics useful in diapers have lengths of about 1 to 3 inches, more preferably 1.25 to 2 inches. The fiber can have a denier in the range of about 0.25–100 dpf (denier per fiber). The fiber denier is preferably 0.25 to 18 dpf, and more preferably 0.25 to 3 dpf.

For the purposes of the present disclosure, the term "polymer fibers" shall refer generally to fibers that may be used in accordance with this invention. Such polymer fibers can comprise various polymeric materials, such as polyolefins, polyesters, polyamides, ethylene-vinyl acetate copolymers ethylene-acrylic acid copolymers, as well as copolymers and polymeric alloys and blends thereof. For example, polyolefins can comprise polyethylenes such as low density polyethylenes, high density polyethylenes, and linear low density polyethylenes, including polyethylenes prepared by copolymerizing ethylene with at least one $C_3$–$C_{12}$ alpha-olefin; polypropylenes; polybutenes, such as poly-1-butenes, poly-2-butenes, and polyisobutylenes; and poly-4-methyl-1-pentenes. Polyesters can comprise poly (oxyethyleneoxyterephthaloyl); and polyamides can comprise poly(imino-1-oxohexamethylene) (Nylon-6), hexamethylene-diaminesebacic acid (Nylon 6–10), and polyiminohexamethyleneiminoadipoyl (Nylon 66).

Preferably, the polymeric material comprises polyolefins, especially polypropylene. The polypropylene can comprise any polypropylene that is spinnable. The polypropylene can be atactic, heterotactic, syndiotactic, isotactic and stereoblock polypropylene—including partially and fully isotactic, or at least substantially fully isotactic—polypropylenes. The polypropylenes can be produced by any process. For example, the polypropylene can be prepared using Zeigler-Natta catalyst systems, or using homogeneous or heterogeneous metallocene catalyst systems.

Further, as used herein, the terms polymers, polyolefins, polypropylene, polyethylene, etc., include homopolymers, various polymers, such as copolymers and terpolymers, and mixtures (including blends and alloys produced by mixing separate batches or forming a blend in situ). For example, the polymer can comprise copolymers of olefins, such as propylene, and these copolymers can contain various components. Preferably, in the case of polypropylene, such copolymers can include up to about 20 weight %, and, even more preferably, from about 0 to 10 weight % of at least one of ethylene and butene. However, varying amounts of these components can be contained in the copolymer depending upon the desired fiber.

With regard to polyolefins, the term "polyolefin-containing fiber or filament" is defined as including, but not being limited to, either continuous or staple melt spun fiber which is obtainable from polyolefins, preferably polypropylene, such as conventionally blended isotactic polypropylene. The term also includes hydrophobic copolymers thereof with ethylene, 1-butene, 4-methyl-1-pentene and the like. The resulting spun melt preferably has a molecular weight average varying from about $3\times10^5$ to about $5\times10^5$, a molecular weight distribution of about 5.0–8.0, a spun melt flow rate of about 13.0 to about 40.0 g/10 minutes, and a spin temperature conveniently within the range of about 220°–315° C.

The fibers being treated according to the present invention can be skin-core fibers such as disclosed in Kozulla, U.S. Pat. Nos. 5,281,378, 5,318,735, and 5,431,994, Kozulla, U.S. application Ser. No. 08/358,884 (filed Dec. 19, 1994), abandoned, and European Application No. 0 719 879, and in Takeuchi et al., European Patent Application No. 0 630 996, all of which are incorporated by reference as if set forth in their entireties herein. Other fibers treatable with the finish according to the present invention include skin-core fibers comprising blends of polypropylene and polymeric bond curve flattening agents such as ethylene vinyl acetate copolymer, disclosed in Harrington et al., U.S. patent application Ser. No. 08/625,073, now abandoned and Harrington et al., U.S. patent application Ser. No. 08/728,491, pending the disclosures of which are incorporated by reference as if set forth in their entireties herein. Fibers may be prepared by the long-spin or short-spin processes as well as any other process, such as being spunbond. The finishes of the invention are particularly well-suited for staple fibers and their use in making nonwoven fabrics.

The finishes of the present invention comprise hydrophobic esters which may be generally obtained by reacting carboxylic acids with polyols of formula $C((CH_2)_nOH)_4$ where n is an integer between 1 and 3, inclusive, blends of these polyols, oligomers of these polyols and oligomers of blends of these polyols. Also included are blends of these reaction products. These polyols are referred to herein as pentaerythritol homologs.

The pentaerythritol homolog dimer, an oligomer of two molecules of pentaerythritol homolog, may be represented by:

$$(HO(CH_2)_j)_3C—(CH_2)_j—(CH_2)_k—C((CH_2)_kOH)_3$$

where j and k are independently integers between 1 and 3, inclusive. Although the dimer may be manufactured by any means, it is useful to think of the dimer as the product of a dehydration reaction between the hydroxy groups of two molecules of polyol, thus forming the ether linkage. Higher oligomers such as trimer and tetramers are similarly defined.

Finishes of the present invention comprise at least one ester of at least one dimer of a pentaerythritol homolog. These esters may be represented by:

$$(R\overset{O}{\overset{\|}{C}}O(CH_2)_j)_3C—(CH_2)_j—O—(CH_2)_k—C((CH_2)_k\overset{O}{\overset{\|}{O}}CR)_3$$

where j and k are independently integers between 1 and 3, inclusive, and R is defined below.

The term "ester of pentaerythritol (or PEOH) homolog" refers to any of the above esters as well as any mixture of them, including, for example, a mixture of ester of the monomer and dimer. Ester of PEOH homolog may additionally comprise other PEOH homolog oligomer esters, such as ester of trimer or tetramer.

Where n is 1, the polyol is pentaerythritol (PEOH), i.e., $C(CH_2OH)_4$. A preferred embodiment of the present invention employs ester of PEOH and PEOH oligomers. As used in this disclosure, mono-pentaerythritol (mono-PEOH) ester is represented by $$C(CH_2\overset{O}{\overset{\|}{O}}CR)_4 \quad (1)$$

wherein each R substituent is independently selected as described below. Because there are four R groups on the mono-PEOH ester, it may be referred to more specifically as a mono-PEOH tetraester, or simply as a PEOH tetraester.

Di- and tri-PEOH esters are esters of the dimer or trimer, respectively, of PEOH.

Di-pentaerythritol (di-PEOH) ester, wherein j and k both are 1, is represented by:

$$(R\overset{O}{\overset{\|}{C}}OCH_2)_3CCH_2OCH_2C(CH_2\overset{O}{\overset{\|}{O}}CR)_3 \quad (2)$$

wherein each R substituent is also independently selected as described below. Because there are six R groups on the di-PEOH ester, it may be referred to more specifically as a di-PEOH hexaester.

Tri-pentaerythritol (tri-PEOH) ester is represented by:

$$(R\overset{O}{\overset{\|}{C}}OCH_2)_3CCH_2OCH_2\underset{\underset{CH_2O\overset{O}{\overset{\|}{C}}R}{|}}{\overset{CH_2O\overset{O}{\overset{\|}{C}}R}{|}}CH_2OCH_2O(CH_2\overset{O}{\overset{\|}{O}}CR)_3 \quad (3)$$

wherein each R substituent is also independently selected as described below. The term PEOH ester refers to any of the above esters of pentaerythritol as well as any mixture of them. PEOH ester may additionally comprise other PEOH oligomer esters, such as a tetra-PEOH ester.

These esters may be manufactured in any manner, such as by the process of McNeil, U.S. Pat. No. 2,961,406, which describes the manufacture of the mono-PEOH tetraester and the di-PEOH hexaester through a reaction between one or more alkanoic acids and a blend of mono- and di-PEOH. Suitable acids described therein include acetic acid, propanoic acid, butanoic acid, 2-methylpropanoic acid, pentanoic acid, hexanoic acid, heptanoic acid, octanoic acid, 2-ethylhexanoic acid and nonanonic acid.

Alternatively to McNeil, the alkanoic acid or mixture of acids may also be reacted, for example, with separate batches of the mono- and di-PEOH, the resultant batches of tetraester and hexaester being later combined. Also, more generally than McNeil, which teaches the use of alkanoic acids, the acid or mixture of acids may be selected from carboxylic acids; these acids may be normal or branched, saturated or unsaturated, aliphatic or aromatic, or any combination of these.

The R substituents of the above mono- and di-PEOH esters may be selected generally from hydrogen and hydrocarbyl groups. It is understood that hydrocarbyl groups include normal and branched hydrocarbyl groups, and saturated and unsaturated hydrocarbyl groups, and combinations of these. Further, it is understood that hydrocarbyl groups include aliphatic, cycloaliphatic, and aromatic groups, such as alkyl, alkenyl, alkynyl, cycloalkyl, aryl, aralkyl, and alkaryl groups. Yet additionally, hydrocarbyl groups are understood as including both nonsubstituted hydrocarbyl groups and substituted hydrocarbyl groups, with the latter referring to the hydrocarbyl portion bearing additional substituents, besides the carbon and hydrogen; correspondingly, aliphatic, cycloaliphatic, and aromatic groups are understood as including both nonsubstituted aliphatic, cycloaliphatic, and aromatic groups, and substituted aliphatic, cycloaliphatic, and aromatic groups, with the latter referring to the aliphatic, cycloaliphatic, and aromatic portion bearing additional substituents, besides the carbon and hydrogen.

In this regard, it is particularly noted that hydrocarbyl groups may include at least one hydrolytically stable heteroatom group; here, "hydrolytically stable" is understood as meaning that the group does not undergo hydrolysis in the presence of an aqueous medium. Suitable hydrolytically stable heteroatom groups include ether, ester, amide, sulfide, sulfone, sulfoxide, and tertiary amine linkages. Also included are halogenated hydrocarbyl groups such as chlorinated or fluorinated alkanes.

The fibers and fabrics of the present invention are hydrophobic. One method of determining the hydrophobicity of a fiber is by measuring the hydrostatic head height (HHH); the details of this test are disclosed below. Preferably, the hydrostatic head height is at least about 30 mm; even more preferably at least about 62 mm; even more preferably at least about 102 mm; even more preferably at least about 125 mm; even more preferably at least about 150 mm; even more preferably at least about 181 mm; even more preferably at least about 195 mm; and most preferably at least about 210 mm.

In order to impart hydrophobic character to the fiber or fabric, it is desirable that the ester of the PEOH homolog dimer itself be hydrophobic. When the ester is prepared through a reaction between the PEOH homolog and carboxylic acids, there may be residual unreacted hydrophilic hydroxy groups on the polyol bases. The hydrophobic nature of the ester may be enhanced by reducing or minimizing the number of unreacted hydroxy groups. This may be achieved, for example, by reacting a PEOH homolog with an excess of carboxylic acid, and preferably removing the water formed, thus driving the reaction to substantially complete esterification of the hydroxy groups.

The R groups of the PEOH ester can comprise any combination of substituents as long as a resulting mixture of PEOH ester is hydrophobic. In other words, the substituents on the esters are selected so as to provide a hydrophobic PEOH ester composition. Preferably, the R groups independently comprise hydrogen or $C_1$–$C_{22}$ hydrocarbyl groups, more preferably hydrogen or $C_1$–$C_{14}$ groups, even more preferably $C_4$–$C_9$ hydrocarbyl groups. Even more preferably, the R groups independently comprise hydrogen or $C_1$–$C_{22}$ alkyl groups, more preferably, hydrogen or $C_1$–$C_{14}$ alkyl groups, and even more preferably, $C_4$–$C_9$ alkyl groups. Even more preferred are saturated $C_4$–$C_9$ alkyl groups, that is, mono- and di-PEOH esters of $C_5$–$C_{10}$ monobasic saturated acids, preferably a blend of monobasic $C_5$–$C_{10}$ normal saturated fatty acids.

Examples of acids that may be reacted with the polyol include, but are not limited to, formic acid, acetic acid, propanoic acid, propenoic acid, buytric acid, isobutyric acid, malonic acid, valeric acid, glutaric acid, caproic acid, adipic acid, caprylic acid, capric acid, decandioic acid, palmitic acid, dodecandioic acid, palmitoleic acid, stearic acid, oleic acid, linolenic acid, behenic acid and erucic acid.

It is again pointed out that while the PEOH esters of the present invention may be prepared, for example, as described above, any method of manufacture of the mono- and di-PEOH esters is satisfactory if it yields PEOH esters.

The PEOH esters may be described in this disclosure as being esters of PEOH and a particular acid or blend of acids. It should be understood that this description is merely shorthand to describe both the distribution of R groups as defined above, and the various proportions of mono-, di- and higher-PEOH with which the acid or acids are reacted. A description of PEOH esters as esters of PEOH and a particular acid or blend of acids does not in any way limit the method of manufacture of the esters.

As a fiber finish, the lubricant may be applied topically, optionally with an antistat and/or other lubricants and/or other additives, to increase processability while retaining hydrophobicity of the fiber. Because esters tend to be hydrophilic, the ability of these esters to impart a high degree of hydrophobicity to polymer fibers is unexpected. Further, when nonwoven polyolefin-containing fabric is prepared from fibers or filaments prepared with these esters, the nonwoven fabrics surprisingly exhibit increased strength, such as cross-directional strength, when compared to nonwoven fabrics of the prior art.

When employed in a fiber finish, such as a spin finish, the di-PEOH esters are preferably present in sufficient quantity to provide the finish composition with enough viscosity to allow retention of the finish on the fiber. If an insufficient amount of di-PEOH ester is in the composition, the finish may not adhere well to the fiber or may be removed through contact with the processing equipment. In order to obtain the necessary viscosity, it is preferable that the PEOH ester composition comprise about 1–90% by weight of the di-PEOH ester, measured relative to the total amount of PEOH ester, and more preferably, from about 5–85% by weight of di-PEOH ester. A preferred embodiment contains 12% by weight of di-PEOH ester. The remainder of the composition can comprise mono-PEOH ester, except that up to 10% by weight of the composition may comprise tri- and higher PEOH esters. The composition may also contain impurities.

Pentaerythritol esters falling within the scope of the present invention are commercially available from Hercules Incorporated (Wilmington, Del.) as HERCOLUBE® and HERCOFLEX® synthetic esters. These synthetic PEOH esters are essentially mixtures of mono- and di-pentaerythritol esters of $C_5$–$C_{10}$ fatty acids. Tri-PEOH ester and esters of higher PEOH oligomers may also be present. Preferably, less than 1% by weight of the PEOH ester comprises impurities. Specific products coming within the scope of the invention include HERCOLUBE® F, HERCOLUBE® J, HERCOLUBE® 202 and HERCOFLEX®) 707A.

In addition to being excellent fiber lubricants, PEOH esters are thermally stable due to the neopentyl structure in which labile beta-hydrogens are absent from the alcohol portion of the molecule. Moreover, the ester functionality of the pentaerythritol esters render them compatible with phosphate or other polar antistats, which helps to eliminate deposit problems such as discussed in Harrington, U.S. Pat. No. 5,540,953 and European Patent Application No. 557, 024, which are incorporated by reference as if set forth in their entirety herein.

The finishes described herein may be applied to the fibers in any manner which one having ordinary skill in the art can readily ascertain, such as a spin finish or an overfinish. For example, as a spin finish, the composition may be made into an emulsion, such as an oil-in-water (o/w) emulsion, and sprayed onto the extruded fibers. Alternatively, a nonwoven fabric may be dipped into an emulsion comprising the finish, or the finish may be applied by rollers. The finish may be applied at any point in the manufacturing process, but is at least preferably applied as a spin finish upon extrusion of the fibers.

In the present disclosure, "active ingredients," when used with regard to an o/w emulsion, refers to all components of the emulsion aside from water. The term includes any ingredients soluble in, or actually dissolved in, the aqueous phase.

When used with a finish not in the form of an emulsion, "active ingredients," refers to the composition as a whole.

When a finish of the present invention is applied as an oil-in-water (o/w) emulsion, it may be prepared from a stock emulsion containing a high proportion of PEOH ester. The stock emulsion preferably includes one or more surfactants to improve the emulsifiability and/or stability of the emulsion. The stock emulsion may be prepared in any manner which one having ordinary skill in the art can readily ascertain. A partial illustrative list of suitable surfactants includes polysorbate 85 (available as Tween® 85, (ICI Surfactants, Wilmington, Del.), and PEG 400 monolaureate. The stock emulsion may be prepared, for example, in a laboratory or commercial emulsifier or homogenizer. When a surfactant is used, it may be present in an amount of about 10% or less by weight of the lubricant including the PEOH ester and other lubricants, if present, and preferably about 4% or less. The 15 active ingredients may comprise about 10–90% by weight of the stock emulsion, preferably about 20–80%, and more preferably about 35–65%, about 50% being especially preferred.

When a finish composition of the present invention comprising an oil-in-water (o/w) emulsion is prepared from a stock emulsion as described above, it is preferably diluted with water. The amount of active ingredients in the emulsion will vary according to such factors as the processing equipment, the synthetic fiber or fabric, and the desired properties of the final product. While the amount of active ingredient may vary according to the circumstances, the finish composition in the form of an emulsion preferably comprises about 30–99.9% of water by weight, 80–99% being more preferred, and 90–98% even more preferred.

The amount of the finish applied to the fiber can vary, and may depend, for example, on processing considerations and/or desired properties of the end product, and those of ordinary skill in the art require some flexibility in determining the proper application ratios. Thus, fiber finishes of the present invention may be applied to fiber or fabric in any amount. Fiber finishes of the present invention are, however, preferably applied in an amount in the range of about 0.1–1.5% of the active ingredient based on the weight of the dry fiber or fabric. Even more preferable is a range of about 0.15–0.8%, with a range of about 0.2–0.6% being most preferable.

Fibers finished with a composition described herein may be made into nonwoven fabrics by methods known in the art, such as spin bonding of continuous fiber or thermal bonding of staple fiber.

Fiber can preferably be made into nonwoven fabric having a basis weight of about 10–50 g/yd$^2$, more preferably from about 10–30 g/yd$^2$, more preferably from about 12–25 g/yd$^2$ and even more preferably from about 12–20 g/yd$^2$ and that has a cross-directional strength of at least about 200 grams/inch, preferably about 200–400 grams/inch, and as high as 650 grams/inch or more, at speeds as high as about 500 ft/min, preferably as high as about 700–800 ft/min, and even more Preferably high as about 980 ft/min (300 m/min), such as by carding and thermally bonding using a calender roll with a thermal bond area of about 15–40%.

Also includable within suitable spun melt employed in carrying out the present invention are various fiber additives, including pH stabilizers such as calcium stearate, antioxidants, pigments, such as whiteners, colorants such as $TiO_2$ and the like. Generally, when such additives are present, they may vary in amount from about 0.01 to 3% collectively by weight of the spun melt.

The lubricants of the present invention may optionally be used in conjunction with any fiber lubricants. Such additional lubricants may be selected, for example, from mineral oils, paraffinic waxes, polysiloxanes, polyglycols, derivatives of these, and others as described herein. An illustrative partial list from this group of additional lubricants includes polydimethylsiloxane, polyethylene glycols and mixed polyethylene-propylene glycols. Also included in this partial list are hydrophobic monoalkyl esters of mixed polyethylene-propylene glycols, polyoxyethylene derivatives and others as taught by Johnson et al., U.S. Pat. No. 5,403,426. Also included are lubricants such as the paraffinic waxes described in WO 94/20664 and WO 95/19465, the disclosures of which are hereby incorporated by reference as if set forth in their entireties herein.

Among the useful silicone lubricants are polysiloxanes having the general formula

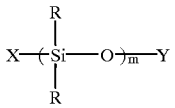

wherein X and Y are individually defined as a hydrophobic chemical end group such as a lower alkyl group; R is individually defined as a lower alkyl, such as a methyl group; and m is a positive number of at least about 10. Within this class of additional lubricants, polydimethylsiloxane is preferred. Lubricants of this type are disclosed in Harrington, U.S. Pat. No. 5,540,953 and Schmalz, U.S. Pat. No. 4,938,832, which are hereby incorporated by reference in their entirety.

The lubricants of the present invention may optionally be used in conjunction with antistatic agents. Any of anionic, neutral, or cationic antistatic agents can be used, such as disclosed in Schmalz, U.S. Patent No. 4,938,832 and in Johnson et al., U.S. Pat. No. 5,403,426, which are incorporated by reference in their entireties. These include, for example, neutralized phosphoric acid esters represented by the formula

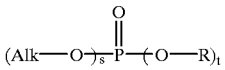

in which Alk is independently defined as a lower alkyl group, inclusive of a 1–8 carbon alkyl such as methyl or octyl; R is independently defined as an amine salt or an alkali metal salt; and s and t are individually defined as positive numbers not less than 1, the sum of which is about 3.

Also satisfactory are the antistat compositions described in Harrington, U.S. Pat. No. 5,540,953, which is incorporated by reference in its entirety. Described therein are antistatic compositions comprising at least one neutralized $C_3$–$C_{12}$ alkyl or alkenyl phosphate alkali metal or alkali earth metal salt and a solubilizer, or a neutralized phosphoric ester salt having the general formula $(MO)_x$—(PO)—$(O(R_1)_nR)_y$ wherein generally M is an alkali or alkali earth metal, $R_1$ is a short-chain alkylene oxide, R is a long-chain alkyl or alkenyl group, n is 1 to 10, and x and y are natural numbers having the sum of three. The solubilizer may be chosen from among glycols, polyglycols, glycol ethers, and neutralized phosphoric ester salts.

Also included are the antistatic agents of WO 94/20664 and WO 95/19465, the disclosures of which are incorporated by reference as if set forth in their entireties herein.

Other phosphate-type antistatic agents include, but are not limited to, those of Wishman et al., U.S. Pat. No. 4,291,093, the disclosure of which is hereby incorporated in its entirety by reference. These antistats include hydrocarbyl phosphate esters, ethoxylated hydrocarbyl phosphate esters, partially hydrolyzed hydrocarbyl phosphate esters, or their salts. Wishman et al defined hydrocarbyl as a hydrocarbon radical selected from the $C_1$–$C_{20}$ alkyl groups, $C_3$–$C_{20}$ cycloalkyl, $C_6$–$C_{20}$ aryl groups, and combinations thereof, such as alkylaryl groups.

Reactive antistatic agents, such as those described in Boardman, U.S. Pat. No. 3,382,096, incorporated by reference as if set forth in its entirety herein, may also be used. The antistatic agents described therein contain, in addition to a functional group that is capable of imparting antistatic properties to hydrophobic material (or antistatic functional group), an additional reactive hydrogen group. Examples of reactive hydrogen groups include the hydroxy, imino, thiol and carboxylic acid groups, and also include phosphorous- or sulfur-containing groups and others as discussed therein. Examples of effective antistatic functional groups include —$CON(CH_3)_2$, —$CON(CH_2CH_3)_2$, —$CONHCH_3$, —COONa, and others as discussed therein.

The esters of the present invention are preferably applied simultaneously with optional material, used as the antistatic agents or additional lubricants, when such additional ingredients are used. If desired, however, other material used, such as antistatic agents or additional lubricants, may instead, or also, be applied before or after the esters of the present invention are applied.

The present invention is found particularly applicable to high-speed production of a variety of nonwoven materials utilizing webs obtained, for example, from spunbonded continuous fiber and/or carded staple, and may also comprise additional web components such as fibrillated film of the same or different polymer. In each case, fiber- or filament-handling difficulties caused by friction and/or accumulated static charge can be controlled without unacceptable sacrifice in strength or hydrophobic properties in the final nonwoven product by use of the fiber finish according to the present invention.

For present purposes, webs used to form nonwovens within the scope of the present invention can be formed by spunbonded or conventional carded processes using staple fiber and bonded together employing adhesive binders (U.S. Pat. No. 4,535,013), calender rolls, hot air, sonic, laser, pressure bonding, needle punching and the like, known to the art.

Webs used to fabricate nonwoven material can also usefully comprise conventional sheath/core or side-by-side bicomponent polymer fiber or filament, alone or combined with treated or untreated homogeneous-type fiber or filament and/or fibrillated film.

Also within the scope of the present invention is the use of nonwovens comprised of one or more bonded webs of modifier-treated polymer fiber- and/or fiber-like (fibrillated film) components having a mixed fiber denier of homogeneous and/or bicomponent types not exceeding about 40 dpf. Such webs preferably utilize fiber or filaments within a range of about 0.25–18 dpf. Also within the scope of the present invention are hydrophobic nonwoven fabrics of blended fibers with low denier-per-fiber and/or low average pore size as disclosed in Freeman et al., U.S. patent application Ser. No. 08/238,324, now U.S. Pat. No. 5,683,809, the disclosure of which is incorporated by reference as if set forth in its entirety herein.

Additionally, the resulting nonwoven material can be embossed and/or calender printed conventionally with various designs and colors, as desired, to increase loft, augment wet strength, and provide easy market identification.

Webs used in forming nonwovens within the scope of the present invention may be produced from one or more types of conventionally spun fibers or filaments having, for example, round, delta, trilobal or diamond cross sections, or cross sections of any other shape.

The following examples are to be considered as illustrative and not as limiting the invention in any way. Other applications of the present invention will be apparent to those in the art in view of the present specification.

EXAMPLES

The invention is further described with the following examples, which are intended to be exemplary and not limiting. Unless otherwise noted, parts are by weight.

The compositions of the various grades of PEOH Esters used in the Examples are shown in Table 1. Where the weights of the mono- di- and tri-PEOH do not add to 100%, the remainder constitutes trace impurities.

TABLE 1

| | PEOH (weight %) | | | fatty acid contribution mole %) | | | | | |
|---|---|---|---|---|---|---|---|---|---|
| PEOH Ester | mono- | di- | tri- | $C_5$ | $C_6$ | $C_7$ | $C_8$ | $C_9$ | $C_{10}$ |
| #1 | 86.0 | 12.0 | 1.5 | 28–38 | 14–24 | 20–30 | 1–11 | 12–22 | — |
| #2 | 8.0 | 82.0 | 10.0 | 59–69 | — | — | 19–29 | — | 6–16 |
| #3 | 89.0 | 9.0 | 1.4 | 1–4 | — | 60–70 | 20–25 | — | 10–25 |
| #4 | 89.0 | 9.0 | 1.4 | 60–80 | — | 2–20 | 10–20 | — | 6–12 |

The PEOH Esters of Table 1 are also commercially available as o/w emulsions under the trademark LUROL from George A. Goulston Co. Inc., Monroe, N.C., which comprise 38% PEOH ester and 2.4% surfactant, with the remainder being water, so that the active ingredients comprise 40.4% of the weight of the emulsion. In the Examples below, a given weight of LUROL® PEOH emulsion refers to the weight of the active ingredients of the emulsion. Similarly, the LUROL® PP 5228 emulsions of polydimethylsiloxane are measured relative to the 50% of active ingredients.

Test Methods

In the following Examples, fibers are prepared and then made into nonwoven fabric. The fibers are tested for hydrophobicity using the Hydrostatic Head Test (HHH). The fabrics are tested for cross-directional strength, percent elongation at point of breakage, and tensile energy absorbed (TEA). These procedures are now presented in detail.

Hydrostatic Head Test:

This modified "Suter" apparatus is an alternative method to A.A.T.C.C. 1952-18 British Standard 2823 apparatus. The hydrostatic pressure was applied to the top of a 5 gram sample of hand carded (i.e., with wire brushes) staple fiber and was controlled by a rising water column at a constant rate of 290 cc/min. The area diameter of the exposed sample was 3.7 cm. A mirror was fixed so that the under side of the sample could be observed. The mirror was adjusted so that it was possible to see the bottom of the multiple hole cap. The sample holder was 3.7 cm inside diameter×3.0 cm long with a screen in the top and a cap with multiple holes to allow the water to flow through. The column height above the sample screen was 60 cm. The water was added to the column through a 0.5 cm vertical hole 2.0 cm above the sample screen. A 0.5 cm diameter drain hole was placed 0.5 cm above the sample screen of the column to remove the water after each test.

The procedure was begun by plugging the column drain hole. Then, 5 grams (±0.10 grams) of dry, hand carded staple fiber was obtained and placed in the sample holder of the column, and the cap was placed on the column. The sample was compressed tightly in the sample holder. Water was pumped into the column at a rate of 290 cc/min until the first drop of water was observed to fall, and the addition of water was immediately stopped and the water column height was measured in millimeters (mm). The column was opened and drained. The wet sample was removed and the chamber and mirror were thoroughly dried. This procedure was repeated for a total of five results per fiber sample and results were reported as the average hydrostatic head height (HHH) in millimeters of rising water.

Cross-Directional Strength, Elongation and Toughness:

Cross-directional breaking strength (load) and elongation were measured using the "cut strip test" of ASTM D-1682 and were calculated using the tensile tester Model 1122 (Instron, Corp., Canton Mass.) (CRT-Constant Rate of Traverse Tensile Testing Machine) using the following speeds:

Chart Speed 2 inches/minute

Crosshead Speed 5 inches/min

Gauge Length 5 inches

Extension Rate 1 00%/min

The test specimens were 1 inch (25 mm) in width and 7 inches (180 mm) in length. Six specimens of each nonwoven fabric were prepared with their long dimension parallel to the cross-machine direction The results are reported as the average breaking load in grams/inch (cross-directional strength) and the apparent elongation in percent. The fabric toughness, reported as tensile energy absorbed (TEA) was also measured and reported. The TEA is defined as the energy to break the fabric based on the area under the stress-strain curve.

Example 1

Polypropylene in flake form (crystallinity 60%; $M_w$ 3.5×$10^5$; molecular weight distribution 5.7; melt flow rate of 9.5 grams/10 min.) was mixed in an impact blender with 0.05%, relative to weight of the polymer, of phosphite stabilizer (available as Irgafos® 168 from Ciba-Geigy Corp., Taryytown, N.Y.). After thorough blending, the mixture was fed into 1.5 inch (3.81 cm) extruder, spun through a 1068 hole spinnerette at 300° C. and air quenched, thereby forming a multi-filament fiber with an average melt flow rate of 35 g/10 min. The multi-filament fiber was passed over a feed or kiss roll partly immersed in a tank of a spin finish composition. The spin finish composition was prepared by emulsifying 1.67% PEOH ester #1, 0.83% potassium butyl phosphate (LUROL® AS-Y, George A. Goulston Co., Inc., Monroe, N.C.) and 0.017% TWEEN® 85 (ICI Surfactants, Wilmington, Del.) with water to 100% using a DISPERSMAT CV (VMA-Getzmann GMBH). The contact between the fiber and the kiss roll was of sufficient duration and speed to apply about 0.25 weight percent of the finish based on the weight of the dry fiber.

The above spin finish was prepared by weighing out the potassium butyl phosphate (LUROL® AS-Y, George A. Goulston Co., Inc., Monroe, N.C.) into the hopper of an agitator and adding the proper amount of water. The drum of LUROL® PP6766 was agitated for 5 minutes. The proper amount of LUROL® PP6766 was then weighed out into the hopper. 1%, by total weight of the finish, of a biocide (NUOSEPT® 95, 50% hemiacetals in water, available from Nuodex Inc. division of HULS America Inc. (Piscataway, N.J.)) was also added to the hopper, and the agitator was run for 30 minutes.

The multi-filament fiber was stretched at a draw ratio of 1.75 at 80° C. to obtain 1.8 dpf round filaments. The resulting continuous filaments were crimped with steam at 100° C. Anover finish was applied after the crimper as a composition comprising 50% by weight potassium butyl phosphate (LUROL® AS-Y, George A. Goulston Co., Inc., Monroe, N.C.) and 50% water. This over finish was applied by slot bar at 0.10 weight percent. After air drying, the 1.8 dpf fibers were cut into 1.5 inch length staple. The hydrophobicity of the staple was tested by the hydrostatic head test as descibed above.

Two ply webs of staple were identically oriented and stacked (primarily in the machine direction), and bonded using a diamond-design embossed calendar roll and a smooth lower roll at roll pressures of 240 pounds per linear inch (420 Newtons per linear centimeter). The diamond calendar roll had a 15% land area, 379 spots/sq. in. with a depth of 0.030 inches. Further, the diamonds had a width of 0.040 inch, a height of 0.20, and are spaced height-wise 0.088 inch on center. The bonding was performed at line speeds of 250 ft/min and at a temperature of 166° C. to produce a nonwoven fabric of 19–20 grams/$yd^2$. The test nonwoven fabric was cut into strips for carrying out the cross directional strength and elongation tests described above.

Example 2

Polypropylene staple fibers and nonwoven fabrics were prepared as in Example 1 with the following changes. The spin finish composition was an emulsion comprising 1.67% potassium butyl phosphate (LUROL® AS-Y, George A. Goulston Co., Inc., Monroe, N.C.), 0.83% PEOH ester #2, 0.017% polysorbate 85 (sold Tween® 85, ICI Surfactants, Wilmington, Del.) and water to 100%.

Comparative Example 1

Polypropylene staple fibers and nonwoven fabrics were prepared as in Example 1 with the following changes. The spin finish composition was an aqueous solution comprising 1.67% potassium butyl phosphate (LUROL® AS-Y, George A. Goulston Co., Inc., Monroe, N.C.), 0.83% polydimethylsiloxane (NUDRY® 90S available from Witco, Charlotte, N.C.) and 97.5% water.

The above spin finish was prepared by weighing out the potassium butyl phosphate (LUROL® AS-Y, George A. Goulston Co., Inc., Monroe, N.C.) into the hopper of an agitator and adding the proper amount of water. The drum of NUDRY® 90S was agitated for 5 minutes. The proper amount of NUDRY® 90S was then weighed out into the hopper. 1%, by total weight of the finish, of a biocide (NUOSEPT® 95, 50% hemiacetals in water, available from Nuodex Inc. division of HULS America Inc. (Piscataway, N.J.)) was also added to the hopper, and the agitator was run for 30 minutes.

Example 3

Polypropylene in flake form (crystallinity 60%; $M_w$ 3.5×$10^5$; molecular weight distribution 5.7; melt flow rate of 9.5 grams/10 min.) was mixed in an impact blender with 0.05%, relative to weight of the polymer, of IRGAFOS® 168 (Ciba-Geigy Corp.). After thorough blending, the mixture was fed into 1.5 inch (3.81 cm) extruder, spun through a 675 hole spinnerette at 305° C. and air quenched, thereby forming a multi-filament fiber with an average melt flow rate of 35 grams/10 min. The multi-filament fiber was passed over a feed or kiss roll partly immersed in a tank of a spin finish comprising an o/w emulsion of 1.3% potassium butyl phosphate (LUROL® AS-Y, George A. Goulston Co., Inc., Monroe, N.C.), 0.7% LUROL® PP6766 (an emulsion of PEOH Ester #1, available from George A. Goulston Co. Inc., Monroe, N.C.) with water to 100%. The contact between the fiber and the kiss roll was of sufficient duration and speed to apply about 0.25 weight percent of the finish based on the weight of the dry fiber.

The above spin finish was prepared by weighing out the potassium butyl phosphate into the hopper of an agitator and adding the proper amount of water. The drum of LUROL® PP 6766 was agitated for 5 minutes. The proper amount of LUROL® PP 6766 was then weighed out into the hopper. 1%, by total weight of the finish, of a biocide (NUOSEPT® 95, 50% hemiacetals in water, available from Nuodex Inc. division of HULS America Inc. (Piscataway, N.J.)) was also added to the hopper, and the agitator was run for 30 minutes.

The multi-filament fiber was stretched at a draw ratio of 1.15 at 80° C. to obtain 2.0 dpf round filaments. The resulting continuous filaments were crimped with steam at 100° C. An over finish was applied as a composition comprising 50% by weight potassium butyl phosphate (LUROL® AS-Y, George A. Goulston Co., Inc., Monroe, N.C.) and 50% water. The over finish was applied by slot bar at 0.10 weight percent. After air drying, the 2.0 dpf fibers were cut into 1.88 inch length staple. The hydrophobicity of the staple was tested by the hydrostatic head test as described above.

Two-ply webs of staple were identically oriented and stacked (primarily in the machine direction), and bonded using a diamond-design embossed calendar roll and a smooth lower roll at roll pressures of 240 pounds per linear inch (420 Newtons per linear centimeter). The diamond calendar roll had a 15% land area, 379 spots/sq. In with a depth of 0.030 inches. Further, the diamonds had a width of 0.040 inch, a height of 0.20, and are spaced height-wise 0.088 inch on center. The bonding was performed at line speeds of 250ft/min and at a temperature of 166° C. to produce a nonwoven fabric of 19–20 grams/$yd^2$. The test nonwove fabric ws cut into strips for carrying out the cross directional strength and elongation tests described above.

Example 4

Polypropylene staple fibers and nonwoven fabrics were prepared as in Example 3 with the following changes. The spin finish composition was an o/w emulsion comprising 1.3% potassium butyl phosphate (LUROL® AS-Y, George A. Goulston Co., Inc., Monroe, N.C.), 0.7% LUROL® PP 6767 (an emulsion of PEOH Ester #2, available from George A. Goulston Co. Tech., Inc., Monroe, N.C.) with water to 100%.

Example 5

Polypropylene staple fibers and nonwoven fabrics were prepared as in Example 3 with the following changes. The spin finish composition was an aqueous solution comprising 1.3% potassium butyl phosphate (LUROL® AS-Y, George A. Goulston Co., Inc., Monroe, N.C.), 0.7% LUROL® PP 6768 (an emulsion of PEOH Ester #3, available from George A. Goulston Co. Inc., Monroe, N.C.) with water to 100%.

Example 6

Polypropylene staple fibers and nonwoven fabrics were prepared as in Example 3 with the following changes. The spin finish composition was an aqueous solution comprising 1.3% potassium butyl phosphate (LUROL® AS-Y, George A. Goulston Co., Inc., Monroe, N.C.), 0.7% LUROL® PP 6769 (an emulsion of PEOH Ester #4, available from George A. Goulston Co. Inc., Monroe, N.C.) with water to 100%.

Comparative Example 2

Polypropylene staple fibers and nonwoven fabrics were prepared as in Example 3 with the following changes. The spin finish composition was an aqueous solution comprising 1.3% potassium butyl phosphate (LUROL® AS-Y, George A. Goulston Co., Inc., Monroe, N.C.), 0.7% polydimethylsiloxane (NUDRY 90S available from Witco, Charlotte, N.C.) and 97.5% water.

Example 7

Polypropylene staple fiber was produced using a low speed (200 meters/min.) high hole density compact spin line. Polypropylene in flake form (crystallinity 60%; $M_w$ 3.5×$10^5$; molecular weight distribution 5.7; meltflow [rate of 8.5 grams/10 min.) was fed into an 8 inch (20.3 cm) extruder, spun through a 64030 hole spinnerette at 265° C. and air quenched forming a multi-filament fiber with an average melt flow rate of 20 g/10 min. The multi-filament fiber was passed over a feed or kiss roll partly immersed in a tank of a spin finish composition. The spin finish composition was prepared by emulsifying 2.0% PEOH ester #1 and 0.04% TWEEN® 85 (ICI Surfactants, Wilmington, Del.) in 97.96% water using a DISPERSMAT CV (VMA-Getzmann GMBH). The contact between the fiber and the kiss roll was of sufficient duration and speed to apply about 0.25 weight percent of the finish based on the weight of the dry fiber.

The multi-filament fiber was stretched at a draw ratio of 1.15 at 110° C. to obtain 2.0 dpf round filaments. The resulting continuous filaments were crimped with steam at 100° C. An overfinish was applied as a composition comprising 50% by weight potassium butyl phosphate (LUROL® AS-Y, George A. Goulston Co., Inc., Monroe, N.C.) and 50% water. The over finish was applied by slot bar at 0.10 weight percent. After air drying, the 2.0 dpf fibers were cut into 1.5 inch length staple. The hydrophobicity of the staple was tested by the hydrostatic head test as described above.

Two-ply webs of staple were identically oriented and stacked (primarily in the machine direction), and bonded using a diamond-design embossed calender roll and a smooth lower roll at roll pressures of 240 pounds per linear inch (420 Newtons per linear centimeter). The diamond calender roll had a 15% land area, 379 spots/sq. in. with a depth of 0.030 inches. Further, the diamonds had a width of 0.040 inch, a height of 0.20, and are spaced height-wise 0.088 inch on center. The bonding was performed at line speeds of 250 ft/min and at a temperature of 170° C. to produce a nonwoven fabric of 19–20 grams/yd$^2$. The test nonwoven fabric was cut into strips for carrying out the cross directional strength and elongation tests described above.

Comparative Example 3

Polypropylene staple fibers and nonwoven fabrics were prepared as in Example 7 with the following changes. The spin finish composition was an aqueous solution comprising 2.0% polydimethylsiloxane (NUDRY® 90S available from Witco, Charlotte, N.C.) and 98.0% water.

Example 8

Polypropylene in flake form (crystallinity 60%; $M_w$ 3.5×10$^5$; molecular weight distribution 5.7; melt flow rate of 9.5 grams/10 min.) was mixed in an impact blender with 0.05%, relative to weight of the polymer, of IRGAFOS® 168 (Ciba-Geigy Corp.). After thorough blending, the mixture was fed into a 1.5 inch (3.81 cm) extruder, spun through a 1068 hole spinnerette at 300° C. and air quenched forming a multi-filament fiber with an average melt flow rate of 35 g/10 min. The multi-filament fiber was passed over a feed or kiss roll partly immersed in a tank of a spin finish composition of an aqueous solution comprising 0.9% potassium butyl phosphate (LUROL® AS-Y, George A. Goulston Co., Inc., Monroe, N.C.), 3.6% LUROL® PP 6766 (an emulsion of PEOH Ester #1, available from George A. Goulston Co. Inc., Monroe, N.C.), 0.5% LUROL® PP 5228 (a 50% emulsion of polydimethylsiloxane available from George A. Goulston Co. Inc., Monroe, N.C.) and water to 100%. The contact between the fiber and the kiss roll was of sufficient duration and speed to apply about 0.35 weight percent of the finish based on the weight of the dry fiber.

The above spin finish was prepared by weighing out the potassium butyl phosphate into the hopper of an agitator and adding the proper amount of water. The drum of LUROL® PP 6766 was agitated for 5 minutes. The proper amount of LUROL® PP 6766 was then weighed out into the hopper. 1%, by total weight of the finish, of a biocide (NUOSEPT® 95, 50% hemiacetals in water, available from Nuodex Inc. division of HULS America Inc. (Piscataway, N.J.)) was also added to the hopper, and the agitator was run for 30 minutes.

The multi-filament fiber was stretched at a draw ratio of 1.75 at 80° C. to obtain 1.8 dpf round filaments. The resulting continuous filaments were crimped with steam at 100° C. An over finish was applied as a composition comprising 50% by weight potassium butyl phosphate (LUROL® AS-Y, George A. Goulston Co., Inc., Monroe, N.C.) and 50% water. The over finish was applied by slot bar at 0.10 weight percent. After air drying, the 1.8 dpf fibers were cut into 1.5 inch length staple. The hydrophobicity of the staple fibers was tested by the hydrostatic head test as described above.

Two-ply webs of staple were identically oriented and stacked (primarily in the machine direction), and bonded using a diamond-design embossed calender roll and a smooth lower roll at roll pressures of 240 pounds per linear inch (420 Newtons per linear centimeter). The diamond calender roll had a 15% land area, 379 spots/sq. in. with a depth of 0.030 inches. Further, the diamonds had a width of 0.040 inch, a height of 0.20, and are spaced height-wise 0.088 inch on center. The bonding was performed at line speeds of 250 ft/min and at a temperature of 166° C. to produce a nonwoven fabric of 19–20 grams/yd$^2$. The test nonwoven fabric was cut into strips for carrying out the cross directional strength and elongation tests described above.

Example 9

Polypropylene staple fibers and nonwoven fabrics were prepared as in Example 8 with the following changes. The spin finish composition was an aqueous solution comprising 0.9% potassium butyl phosphate (LUROL® AS-Y, George A. Goulston Co., Inc., Monroe, N.C.), 3.8% LUROL® PP 6766 (an emulsion of PEOH Ester #1, available from George A. Goulston Co. Inc., Monroe, N.C.), 0.3% LUROL® PP 5228 (a 50% emulsion of polydimethylsiloxane available from George A. Goulston Co. Inc., Monroe, N.C.) and water to 100%.

Example 10

Polypropylene staple fibers and nonwoven fabrics were prepared as in Example 8 with the following changes. The spin finish composition was an aqueous solution comprising 1.0% potassium butyl phosphate (LUROL® AS-Y, George A. Goulston Co., Inc., Monroe, N.C.), 3.8% LUROL® PP 6766 (an emulsion of PEOH Ester #1, available from George A. Goulston Co. Inc., Monroe, N.C.), 0.2% LUROL® PP 5228 (a 50% emulsion of polydimethylsiloxane available from George A. Goulston Co. Inc., Monroe, N.C.) and 95.0% water.

Comparative Example 4

Polypropylene staple fibers and nonwoven fabrics were prepared as in Example 8 with the following changes. The spin finish composition was an aqueous solution comprising 3.3% potassium butyl phosphate (LUROL® AS-Y, George A. Goulston Co., Inc., Monroe, N.C.), 1.7% LUROL® PP 5228 (a 50% emulsion of polydimethylsiloxane available from George A. Goulston Co. Inc., Monroe, N.C.) and 95.0% water.

Results

Results of the cross-directional strength, elongation, and hydrostatic head tests performed on the above fibers and nonwoven fabrics are presented in Table 2 below.

TABLE 2

| | Cross-directional Strength (grams/inch) | Elongation | TEA (grams/inch$^2$) | Fiber HHH (mm water) |
|---|---|---|---|---|
| Example 1 | 364 | 62% | 1500 | 275 |
| Example 2 | 300 | 60% | 1100 | 290 |

TABLE 2-continued

| | Cross-directional Strength (grams/inch) | Elongation | TEA (grams/inch$^2$) | Fiber HHH (mm water) |
|---|---|---|---|---|
| Comparative Example 1 | 300 | 74% | 1500 | 276 |
| Example 3 | 659 | 100% | 4494 | 259 |
| Example 4 | 560 | 97% | 3598 | 278 |
| Example 5 | 674 | 95% | 4289 | 254 |
| Example 6 | 669 | 111% | 4961 | 284 |
| Comparative Example 2 | 601 | 111% | 4307 | 283 |
| Example 7 | 560 | 78% | 3300 | 274 |
| Comparative Example 3 | 429 | 78% | 2400 | 260 |
| Example 8 | 447 | 100% | 2794 | 253 |
| Example 9 | 505 | 98% | 3167 | 271 |
| Example 10 | 593 | 90% | 3538 | 237 |
| Comparative Example 4 | 461 | 93% | 2792 | 256 |

Other applications of this invention are also contemplated. For example, replacing the silicone lubricating finish of U.S. Pat. No. 4,938,832 or European Patent Application No. 486,158 with HERCOLUBE® synthetic esters results in improved productivity and improved cardability. Specifically, it permits the processing equipment to card the fiber at greater than 500 feet/minute, and to spin fibers at greater than 1300 meters/minute.

Although the invention has been described with reference to particular means, materials and embodiments, it is to be understood that the invention is not limited to the particulars disclosed and extends to all equivalents within the scope of the claims.

We claim:

1. An essentially hydrophobic polyolefin-containing fiber including a coating comprising at least one ester of pentaerythritol homolog comprising at least one hydrophobic ester of pentaerythritol homolog dimer.

2. The fiber according to claim 1, wherein said fiber is a staple fiber.

3. The fiber according to claim 1, wherein said fiber comprises a denier of 0.25 to 3 dpf.

4. The fiber according to claim 1, comprising at least one antistatic agent in said coating.

5. The fiber according to claim 1, wherein said polyolefin-containing fiber comprises polypropylene.

6. The fiber according to claim 5, wherein said fiber is a staple fiber.

7. The fiber according to claim 6, comprising at least one antistatic agent in said coating.

8. The fiber according to claim 7, further including at least one additional lubricating agent.

9. The fiber according to claim 8, wherein said fiber has a denier between about 0.25 and 3 dpf.

10. The fiber according to claim 7, wherein said fiber has a denier between about 0.25 and 3 dpf.

11. A nonwoven produced from the fiber of claim 7.

12. The fiber according to claim 6, further including at least one additional lubricating agent.

13. The fiber according to claim 2, wherein said fiber has a denier between about 0.25 and 3 dpf.

14. the fiber according to claim 6, wherein said fiber has a denier between about 0.25 and 3 dpf.

15. A nonwoven produced from the fiber of claim 14.

16. A nonwoven produced from the fiber of claim 6.

17. The fiber according to claim 5, wherein said at least one hydrophobic ester of pentaerythritol dimer homolog comprises at least one di-pentaerythritol ester.

18. The fiber according to claim 17, wherein said at least one di-pentaerythritol ester comprises substituents independently selected from the group consisting of hydrogen and $C_1$–$C_{21}$ hydrocarbyl groups.

19. The fiber according to claim 18, wherein said at least one di-pentaerythritol ester comprises substituents independently selected from the group consisting of hydrogen and $C_1$–$C_{21}$ alkyl groups.

20. The fiber according to claim 19, wherein said at least one di-pentaerythritol ester comprises substituents independently selected from the group consisting of hydrogen and $C_1$–$C_{14}$ alkyl groups.

21. The fiber according to claim 20, wherein said at least one di-pentaerythritol ester comprises substituents independently selected from the group consisting of $C_5$–$C_{10}$ alkyl groups.

22. A nonwoven produced from the fiber of claim 17.

23. The fiber according to claim 5, wherein said at least one ester of pentaerythritol homolog comprises a mixture of at least one mono-pentaerythritol ester and at least one di-pentaerythritol ester.

24. The fiber according to claim 23, wherein said fiber is a staple fiber.

25. The fiber according to claim 23, wherein said fiber has a denier between about 0.25 and 18 dpf.

26. The fiber according to claim 23, wherein said fiber has a denier between about 0.25 and 3 dpf.

27. The fiber according to claim 23, wherein the di-pentaerythritol ester is present in the range of about 1–90% by weight of total pentaerythritol ester.

28. The fiber according to claim 27, wherein the at least one di-pentaerythritol ester is present in the range of about 5–85% by weight of total pentaerythritol ester.

29. The fiber according to claim 28, wherein the di-pentaerythritol ester is present in about 12% by weight of total pentaerythritol ester.

30. The fiber according to claim 23, wherein said at least one mono-pentaerythritol ester and said at least one di-pentaerythritol ester comprise substituents independently selected from the group consisting of hydrogen and $C_1$–$C_{22}$ hydrocarbyl groups.

31. The fiber according to claim 30, wherein said at least one mono-pentaerythritol ester and said at least one di-pentaerythritol ester comprise substituents independently selected from the group consisting of hydrogen and $C_1$–$C_{21}$ alkyl groups.

32. The fiber according to claim 31, wherein said at least one mono-pentaerythritol ester and said at least one di-pentaerythritol ester comprise substituents independently selected from the group consisting of hydrogen and $C_1$–$C_{14}$ alkyl groups.

33. The fiber according to claim 32, wherein said at least one mono-pentaerythritol ester and said at least one di-pentaerythritol ester comprise substituents independently selected from the group consisting of $C_5$–$C_{10}$ alkyl groups.

34. The fiber according to claim 33, wherein said at least one mono-pentaerythritol ester and said at least one di-pentaerythritol ester comprise substituents independently selected from the group consisting of saturated $C_5$–$C_{10}$ alkyl groups.

35. The fiber according to claim 23, comprising at least one antistatic agent in said coating.

36. The fiber according to claim 35, wherein said at least one antistatic agent is selected from the group consisting of:

a) neutralized phosphoric acid esters, b) hydrocarbyl phosphate esters, c) ethoxylated hydrocarbyl phosphate esters, d) partially hydrolyzed hydrocarbyl phosphate esters, and, e) antistatic agents which contain, in addition to an antistatic functional group, a reactive hydrogen group, and salts thereof, where the hydrocarbyl groups are independently selected form the group consisting of $C_1$–$C_{20}$ alkyl groups, $C_3$–$C_{20}$ cycloalkyl, $C_6$–$C_{20}$ aryl groups, and combinations thereof.

37. The fiber according to claim 36, wherein said at least one antistatic agent is selected from the group consisting of neutralized phosphoric acid esters and salts thereof.

38. The fiber according to claim 35, wherein the di-pentaerythritol ester is present in the range of about 1–90% by weight of total pentaerythritol ester.

39. The fiber according to claim 38, wherein the at least one di-pentaerythritol ester is present in the range of about 5–85% by weight of total pentaerythritol ester.

40. The fiber according to claim 39, wherein the di-pentaerythritol ester is present in about 12% by weight of total pentaerythritol ester.

41. The fiber according to claim 23, further including at least one additional lubricating agent.

42. The fiber according to claim 41, comprising at least one antistatic agent in said coating.

43. The fiber according to claim 42, wherein the di-pentaerythritol ester is present in the range of about 1–90% by weight of total pentaerythritol ester.

44. The fiber according to claim 43, wherein the at least one di-pentaerythritol ester is present in the range of about 5–85% by weight of total pentaerythritol ester.

45. The fiber according to claim 44, wherein the di-pentaerythritol ester is present in about 12% by weight of total pentaerythritol ester.

46. The fiber according to claim 41, wherein said at least one additional lubricating agent is selected from the group consisting of a) mineral oils, b) paraffinic waxes, c) polysiloxanes having the general formula

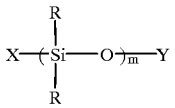

wherein X is a $C_1$–$C_4$ alkyl group; R are independently chosen $C_1$–$C_{10}$ alkyl groups; m is an integer of at least about 10; and Y is —$SiR_2$ wherein $R_2$ is a $C_1$–$C_4$ alkyl group.

47. The fiber according to claim 46, wherein said at least one additional lubricating agent is selected from the group consisting of polysiloxanes having the general formula

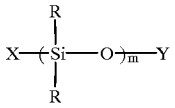

wherein X is a $C_1$–$C_4$ alkyl group; R are independently chosen $C_1$–$C_{10}$ alkyl groups; m is an integer of at least about 10; and Y is —$SiR_2$ wherein $R_2$ is a $C_1$–$C_4$ alkyl group.

48. The fiber according to claim 46, comprising at least one antistatic agent in said coating.

49. The fiber according to claim 48, wherein said at least one antistatic agent is selected from the group consisting of:

a) neutralized phosphoric acid esters, b) hydrocarbyl phosphate esters, c) ethoxylated hydrocarbyl phosphate esters, d) partially hydrolyzed hydrocarbyl phosphate esters, and, e) antistatic agents which contain, in addition to an antistatic functional group, a reactive hydrogen group, and salts thereof, where the hydrocarbyl groups are independently selected form the group consisting of $C_1$–$C_{20}$ alkyl groups, $C_3$–$C_{20}$ cycloalkyl, $C_6$–$C_{20}$ aryl groups, and combinations thereof.

50. The fiber according to claim 5, comprising at least one antistatic agent in said coating.

51. The fiber according to claim 50, further including at least one additional lubricating agent.

52. The fiber according to claim 50, wherein said fiber has a denier between about 0.25 and 3 dpf.

53. The fiber according to claim 5, further including at least one additional lubricating agent.

54. A nonwoven produced from the fiber of claim 5.

55. A nonwoven produced from the fiber of claim 1.

56. An essentially hydrophobic polyolefin-containing fiber including a coating comprising:

(a) at least one mono-pentaerythritol ester and at least one di-pentaerythritol ester comprising substituents independently selected from the group consisting of $C_5$–$C_{10}$ alkyl groups, said di-pentaerythritol ester being present in the range of about 1–90% by weight of total pentaerythritol ester; and (b) at least one antistatic agent.

57. The fiber according to claim 56, wherein said polyolefin-containing fiber comprises polypropylene.

58. The fiber according to claim 57, wherein the at least one di-pentaerythritol ester is present in the range of about 5–85% by weight of total pentaerythritol ester.

59. The fiber according to claim 58, wherein the di-pentaerythritol ester is present in about 12% by weight of total pentaerythritol ester.

60. The fiber according to claim 57, wherein said fiber has a denier between about 0.25 and 18 dpf.

61. The fiber according to claim 60, wherein said fiber has a denier between about 0.25 and 3 dpf.

62. A method of producing substantially hydrophobic polyolefin-containing fiber comprising applying to polyolefin-containing fiber an essentially hydrophobic composition comprising at least one ester of pentaerythritol homolog comprising at least one hydrophobic ester of pentaerythritol homolog dimer.

63. The method according to claim 62, wherein said fiber is a staple fiber.

64. The method according to claim 62, wherein said fiber comprises a denier of 0.25 to 3 dpf.

65. The method according to claim 62, comprising said composition comprises at least one antistatic agent.

66. The method according to claim 62, wherein said polyolefin-containing fiber comprises polypropylene.

67. The method according to claim 66, wherein the composition is applied to said fiber in an amount of about 0.1–1.5% based on the weight of the dry fiber.

68. the method according to claim 66, wherein said fiber has a denier between about 0.25 and 3 dpf.

69. The method according to claim 68, wherein said fiber has a denier between about 0.25 and 3 dpf.

70. A method of producing substantially hydrophobic nonwoven fabric comprising:

a) producing substantially hydrophobic fiber by the method of claim 66, and b) forming the fiber into nonwoven fabric.

71. The method according to claim 70, wherein the forming comprises processing the fiber to obtain at least one web, and bonding the at least one web into nonwoven fabric.

72. The method according to claim 71, wherein the fiber is crimped prior to processing into the at least one web.

73. The method according to claim 72, wherein the fiber is cut into staple fiber after crimping and prior to processing into the at least one web.

* * * * *